US006883746B2

(12) United States Patent
Murachi et al.

(10) Patent No.: US 6,883,746 B2
(45) Date of Patent: Apr. 26, 2005

(54) WINDING DEVICE

(75) Inventors: Atsumi Murachi, Gamo-gun (JP); Hideo Miura, Koka-gun (JP); Takashi Nakamura, Uji (JP)

(73) Assignee: Nishimura Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 10/250,550

(22) PCT Filed: Jan. 4, 2001

(86) PCT No.: PCT/JP01/00003

§ 371 (c)(1),
(2), (4) Date: Jul. 1, 2003

(87) PCT Pub. No.: WO02/055418

PCT Pub. Date: Jul. 18, 2002

(65) Prior Publication Data

US 2004/0026560 A1 Feb. 12, 2004

(51) Int. Cl.[7] ..... B65H 18/10; B65H 75/24

(52) U.S. Cl. ..... 242/571; 242/571.1; 242/571.2; 242/573.7; 242/530.3

(58) Field of Search ..... 242/571, 571.1, 242/571.2, 573, 573.1, 573.2, 573.3, 573.7, 573.9, 407.1; 269/48.1; 279/2.01, 2.06

(56) References Cited

U.S. PATENT DOCUMENTS 3,188,016 A * 6/1965 Aaron ..... 242/530.3
4,307,851 A * 12/1981 Dunaevsky et al. ..... 242/530.3
4,467,977 A * 8/1984 Gattrugeri ..... 242/571.1
6,405,970 B1 * 6/2002 Ueyama ..... 242/573.2

FOREIGN PATENT DOCUMENTS

JP 55158187 11/1980
JP 57081046 A * 5/1982 ..... B65H/19/04
JP 07337933 11/1995
JP 10240044 8/1998

* cited by examiner

*Primary Examiner*—Kathy Matecki
*Assistant Examiner*—Sang Kim
(74) *Attorney, Agent, or Firm*—Kirschstein, et al.

(57) ABSTRACT

A winding device, comprising a ring-shaped holder disposed concentrically with a winding shaft, a ring-shaped slider fitted onto the outer peripheral surface of the holder, and a plurality of chips disposed at angular intervals on a tapered inclined surface formed on the outer peripheral surface of the slider, wherein a fluid pressure passes through a first flow path in the winding shaft, the slider is moved in the axial direction of the winding shaft by a first piston, each chip is moved in the radial direction of the winding shaft by the inclination surface of the slider and pressed against the inner peripheral surface of the winding core so as to hold the winding core, a second piston is pressed against the end face of the holder by a second flow path independent of the first flow path, and the torque of the winding shaft is transmitted to the holder, slider, chips, and winding core by the friction between the second piston and the holder so as to rotate the winding core.

5 Claims, 3 Drawing Sheets

WINDING DEVICE

TECHNICAL FIELD

The invention relates to a winding apparatus for winding a web material such as paper, plastic film about a hollow core.

BACK GROUND

A winding apparatus had been developed and proposed by the applicant, as disclosed in Japanese Patent Publication No. 30,621 of 1985. The apparatus includes a ringed holder disposed around and coaxially with a shaft for rotation about the shaft. A ringed slide is fitted onto the outer surface of the holder for movement axially of the shaft. A tapered surface is formed on the outer surface of the slide. A plurality of tips are spaced from each other angularly around the slide and engaged with the tapered surface for movement radially of the shaft. A hollow core is disposed around the shaft at a position corresponding to the slide and the tips. In addition, an axial piston is disposed on one side of the holder in the axial direction of the shaft and inserted into an axial bore. Fluid pressure is directed into the axial bore through an inner flow path formed in the shaft so that the axial piston can be pressed against the end surface of the slide. The slide is therefore moved axially of the shaft, the tips being moved and expanded radially of the shaft by the tapered surface to be pressed against the inner surface of the core, so as to hold the core. A torque is transmitted to the slide, the tips and the core from the shaft by means of a friction generated between the axial piston and the slide so that the core can be rotated by the torque to thereby wind a web material about the core.

However, the apparatus is problematic in winding tension. For example, it is recently required to wind a web material such as shin film which is liable to extension, and keep the web material from extending to a degree. In this case, it is necessary to wind the web material with a low winding tension. However, in the apparatus, the winding tension is dependent on the torque transmitted to the core and the friction generated between the axial piston and the slide. The less the friction is, the less the torque and the winding tension are. In addition, the fluid pressure is directed into the axial bore through the inner flow path formed in the shaft so that the axial piston can be pressed against the end surface of the slide, as described above. Accordingly, if making the fluid pressure low, the friction must be decreased between the axial piston and the slide in proportion to the fluid pressure. However, if the fluid pressure is too low, the tips cannot be pressed against the inner surface of the core to reliably hold the core. It is therefore unacceptable to make the fluid pressure low to wind the web material with a low winding tension.

It is therefore an object of the invention to wind a web material such as paper, plastic film not only with a high winding tension but also with a low winding tension to be convenient for any material.

DISCLOSURE OF THE INVENTION

According to the invention, in a winding apparatus for winding a web material such as paper, plastic film about a hollow core, a ringed holder is disposed around and coaxially with a shaft for rotation about the shaft. A ringed slide is fitted onto the outer surface of the holder for movement axially of the shaft. A tapered surface is formed on the outer surface of the slide. A plurality of tips are spaced from each other angularly around the slide and engaged with the tapered surface for movement radially of the shaft. First and second pistons are disposed opposite sides of the holder in the axial direction of the shaft and inserted into first and second bores. A first flow path is formed in the shaft. Fluid pressure is directed into the first bore through the first flow path so that the slide can be moved axially of the shaft by the first piston, the tips being moved and expanded radially of the shaft by the tapered surface to a pressed against the inner surface of the core so as to hold the core. A second flow path is formed in the shaft independently of the first flow path. Fluid pressure is directed into the second bore through the second flow path so that the second piston can be pressed against the end surface of the holder, a torque being transmitted to the holder, the slide, the tips and the core from the shaft by means of a friction generated between the second piston and the holder so that the core can be rotated by the torque.

In a preferred embodiment, a plurality of holders are combined with a plurality of slides and spaced from each other axially of the shaft. The tips are spaced from each other angularly around each of the slides. A plurality of cylinder blocks are disposed on the shaft and interposed between the holders. The first and second pistons are inserted into the first and second bores formed in each of the cylinder blocks.

The cylinder blocks are ringed to be disposed around and coaxially with the shaft. A plurality of first bores are formed in each of the cylinder blocks to be spaced from each other angularly around the shaft. A plurality of first pistons are spaced from each other angularly around the shaft and inserted into the first bore. A plurality of second bores are formed in each of the cylinder blocks to be spaced from each other angularly around the shaft. A plurality of second pistons are spaced from each other angularly around the shaft and inserted into the second bores.

A ringed coil spring is disposed around the tips and the slide and fitted into circumferential grooves formed in the tips and the slide. The tips are resiliently urged radially of the shaft by the spring to be engaged with the tapered surface.

A plurality of balls are received in a plurality of cases. The cases are spaced from each other angularly around the shaft at positions between the holders. The balls protrude from the outer surfaces of the cases. The tips are contracted radially of the shaft after winding the web material so that a wound product can be supported on the balls.

BEST MODE TO CARRY OUT THE INVENTION

Figure 1:
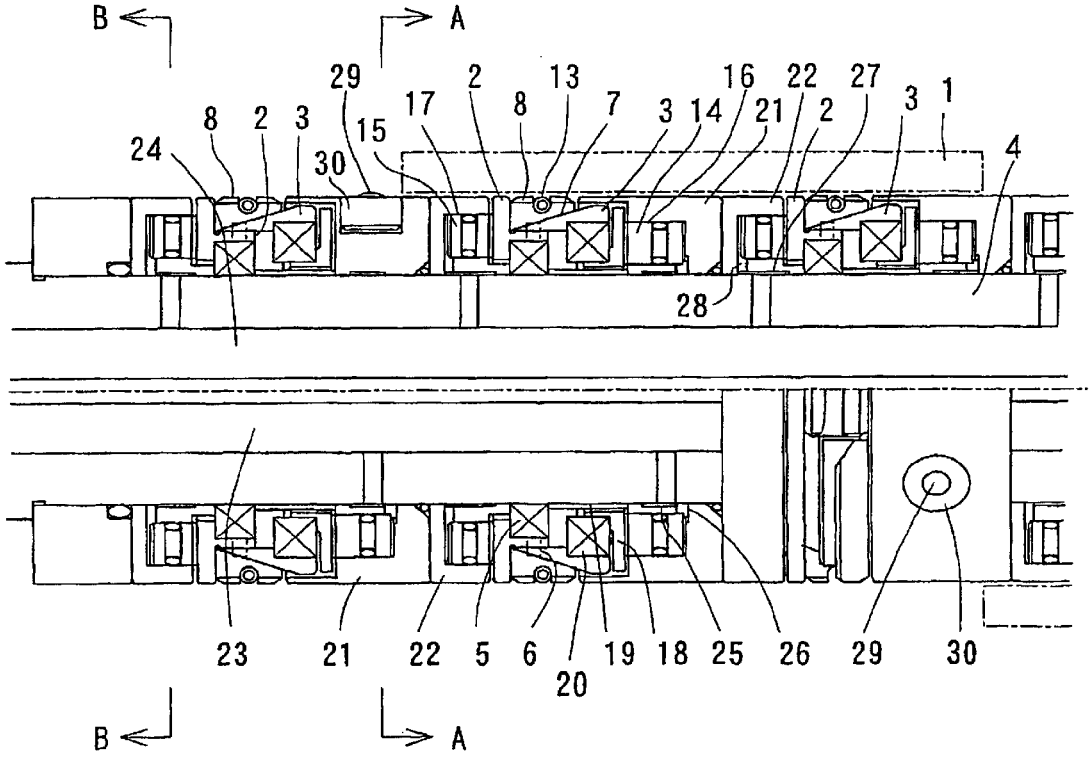
FIG. 1 is a longitudinal sectional view of a preferred embodiment of the invention.

Referring now to the drawings, FIG. 1 illustrates a winding apparatus for winding a web material such as paper, plastic film about a hollow core 1, according to the invention. The apparatus includes a ringed holder 2 and a ringed slide 3, the holder 2 being disposed around and coaxially with a shaft 4 which is connected to a drive motor to be rotated about the axis of the shaft 4 by the motor. A bearing 5 is provided between the holder 2 and the shaft 4 so that the holder 2 can be guided by the bearing 5 for rotation about the shaft 4. The slide 3 is fitted onto the outer surface of the holder 2 to slide therealong for movement axially of the shaft 4. A key 6 is fixed to the holder 2 and fitted into a key groove formed in the slide 3 so that the slide 3 can be constrained by the key 6 and the holder 2 in the rotational direction of the shaft 4 to be kept from being rotated about the holder 2.

Figure 4:
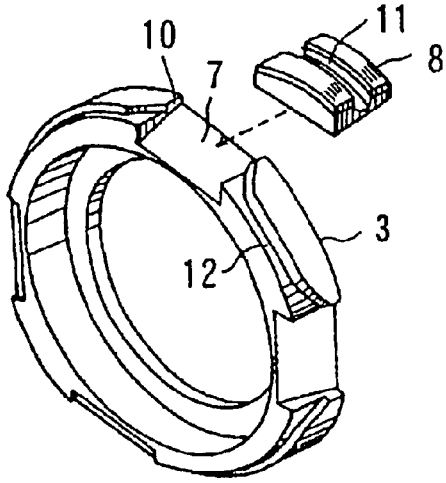
FIG. 4 is a perspective view of the slide and the tip of FIG. 1.

A tapered surface 7 is formed on the outer surface of the slide 3. A plurality of tips 8 are spaced from each other angularly around the slide 3 and engaged with the tapered surface 7 for movement radially of the shaft 4. In the embodiment, a radial surface is formed on the holder 2 so that the tips 8 can be engaged with the radial surface to slide therealong for movement radially of the shaft 4. In addition, a plurality of axial grooves 10 are formed in the outer surface of the slide 3, as shown in FIG. 4. The tapered surface 7 is formed in each of the axial grooves 10. The tips 8 are inserted into the axial grooves 10 to be engaged with the tapered surfaces 7. Accordingly, the tips 8 are constrained by the axial grooves 10 in the rotational direction of the shaft 4 to be kept from being rotated about the shaft 4. The tips 8 and the slide 3 include circumferential grooves 11 and 12 formed therein, a ringed coil spring 13 being disposed around the tips 8 and the slide 3 and fitted into the circumferential grooves 11 and 12. Accordingly, the tips 8 are resiliently urged radially of the shaft 4 by the spring 13 to be engaged with the tapered surface 7.

First and second pistons 14 and 15 are disposed opposite sides of the holder 2 and the slide 3 in the axial direction of the shaft 4 and inserted into first and second bores 16 and 17. The first piston 14 is used for movement of the slide 3. In the embodiment, a ringed flange 18 is fitted onto the outer surface of a collar 19 which is fitted onto the outer surface of the shaft 4 so that the first piston 14 can be opposed to the end surface of the flange 18. The flange 18 can slide along the outer surface of the collar 19 for movement axially of the shaft 4. A bearing 20 is provided between the slide 3 and the flange 18 so that the slide 3 can be guided by the bearing 20 for rotation about the shaft 4. Accordingly, the flange 18, the bearing 20 and the slide 3 can be moved axially of the shaft 4 by the first piston 14. On the other hand, the second piston 15 is used for transmission of a torque from the shaft 4 and opposed to the end surface of the holder 2.

In the embodiment, a plurality of holders 2 are combined with a plurality of slides 3 and spaced from each other axially of the shaft 4. The tips 8 are spaced from each other angularly around each of the slides 3. The holders 2 include the same structure as each other and have the same direction as each other to be combined with bearings 5. The slides 3 include the same structure as each other and have the same directions as each other to be combined with flanges 18, collars 19 and bearings 20. The tips 8 also include the same structure as each other and have the same direction as each other. A plurality of cylinder blocks 21 and 22 are disposed on the shaft 4 and interposed between the holders 2. The first and second pistons 14 and 15 are inserted into the first and second bores 16 and 17 formed in each of the cylinder blocks 21 and 22.

Figure 2:
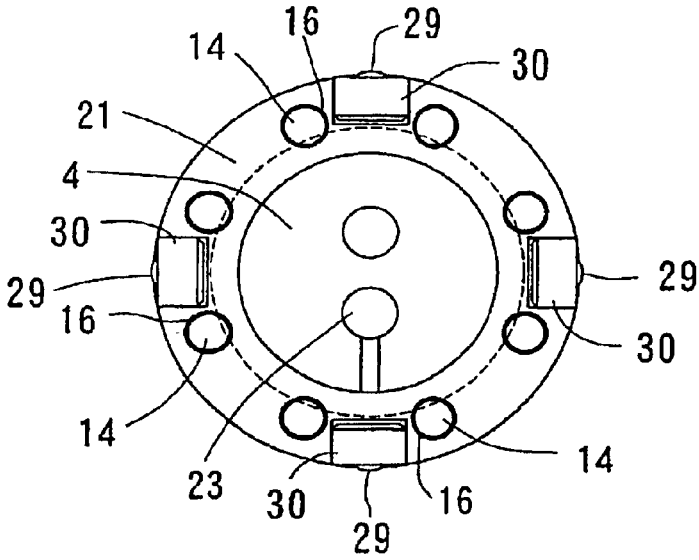
FIG. 2 is a cross sectional view taken along a line of A—A in FIG. 1.
Figure 3:
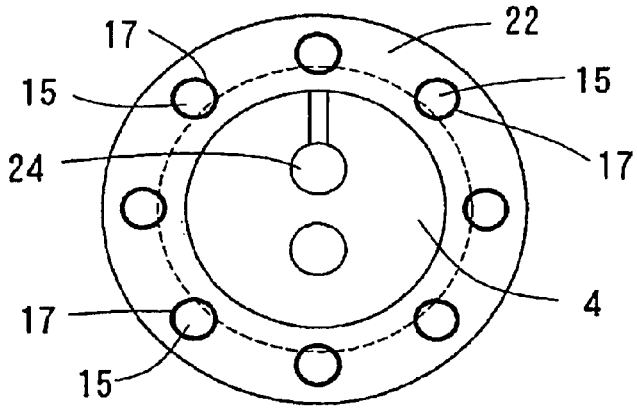
FIG. 3 is a cross sectional view taken along a line of B—B in FIG. 1.

The cylinder blocks 21 and 22 are ringed to be disposed around and coaxially with the shaft 4, as shown in FIG. 2 and FIG. 3. In the embodiment, a plurality of first bores 16 are formed in each of the cylinder blocks 21 to be spaced from each other angularly around the shaft 4. A plurality of first pistons 14 are spaced from each other angularly around the shaft 4 and inserted into the first bores 16. A plurality of second bores 17 are formed in each of the cylinder blocks 22 to be spaced from each other angularly around the shaft 4. A plurality of second pistons 15 are spaced from each other angularly around the shaft 4 and inserted into the second bores 17.

The apparatus includes a first flow path 23 formed in the shaft 4. In addition, a second flow path 24 is formed in the shaft 4 independently of the first flow path 23. The first flow path 23 extends axially of the shaft 4 to be connected to a first source of fluid pressure, not shown, and extends radially of the shaft 4 to be communicated with the first bores 16 through an inner groove 25 and ports 26 formed in each of the cylinder blocks 21. The second flow path 24 extends axially of the shaft 4 to be connected to a second source of fluid pressure, not shown, and extends radially of the shaft 4 to be communicated with the second bores 17 through an inner groove 27 and ports 28 formed in each of the cylinder blocks 22.

The apparatus is incorporated into a slitter in which the web material is directed to a slitting blade to be slit into a plurality of slit materials. The slit materials are then directed to a plurality of cores 1. The apparatus is arranged to wind the slit materials about the cores 1. The cores 1 are made of paper.

In the apparatus, fluid pressure is supplied from the first source to be directed into the first bores 16 through the first flow path 23 formed in the shaft 4 and the inner groove 25 and the ports 26 formed in each of the cylinder blocks 21. In the embodiment, the first source comprises a source of air from which air is directed to the first bores 16. The first pistons 14 are therefore subject to the air in the first bores 16 to be pressed against the end surface of the flange 18 so that flange 18, the bearing 20 and the slide 3 can be moved axially of the shaft 4 by the first pistons 14, the tips 8 being moved and expanded radially of the shaft 4 by the tapered surfaces 7 of the slide 3. The cores 1 are disposed around the shaft 4 and spaced from each other axially of the shaft 4 at positions each of which corresponds to an adjacent pair of slides 3 so that the tips 8 can be pressed against the inner surface of the core 1 so as to hold the core 1.

In addition, fluid pressure is supplied from the second source to be directed into the second bores 17 through the second flow path 24 formed in the shaft 4 and the inner groove 27 and the ports 28 formed in each of the cylinder blocks 11. In the embodiment, the second source comprises a source of air from which air is directed to the second bores 17. The second pistons 15 are therefore subject to the air in the second bores 17 to be pressed against the end surface of the holder 2. The shaft 4 is then rotated by the motor, a torque being transmitted to the holder 2, the slide 3, the tips 8 and the core 1 from the shaft 4 by means of a friction generated between the second pistons 15 and the holder 2 so that the core 1 can be rotated by the torque to thereby wind the web material about the core 1.

It should therefore be recognized in the apparatus that the torque is transmitted to each of the cores 1 by the friction generated between the second pistons 15 and the holder 2. The cores 1 are therefore driven and rotated independently from each other. In addition, the winding tension is dependent on the torque transmitted to the core 1 while the friction is dependent on the fluid pressure in the second bores 17 to be generated between the second pistons 15 and the holder 2. Accordingly, if making the fluid pressure high, the friction must be increased between the second pistons 15 and the holder 2 in proportion to the fluid pressure so that the torque can be increased by the friction and transmitted to the core 1. By contraries, if making the fluid pressure low, the friction must be decreased between the second pistons 15 and the holder 2 in proportion to the fluid pressure so that the torque can be decreased by the friction and transmitted to the core 1. Furthermore, the first pistons 14 are subject to the fluid pressure directed into the first bores 16 independently of the fluid pressure in the second bores 7, to cooperate with the slide 3 and the tips 8 so as to hold the core 1. The fluid pressure can therefore be maintained at a suitable value and directed into the second bores 17 to reliably hold the core 1 when making the fluid pressure low in the first bores 16. The apparatus can therefore wind the web material not only with a high winding tension but also with a low winding tension to be convenient for any material.

Figure 5:
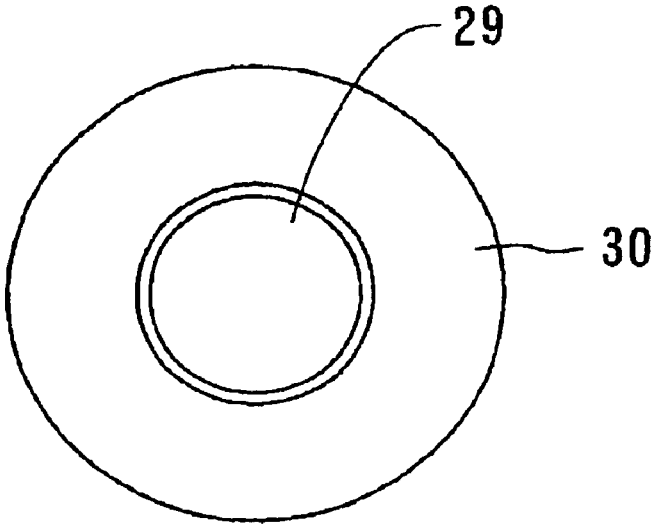
FIG. 5 is a plan view of the ball and the case of FIG. 1.
Figure 6:
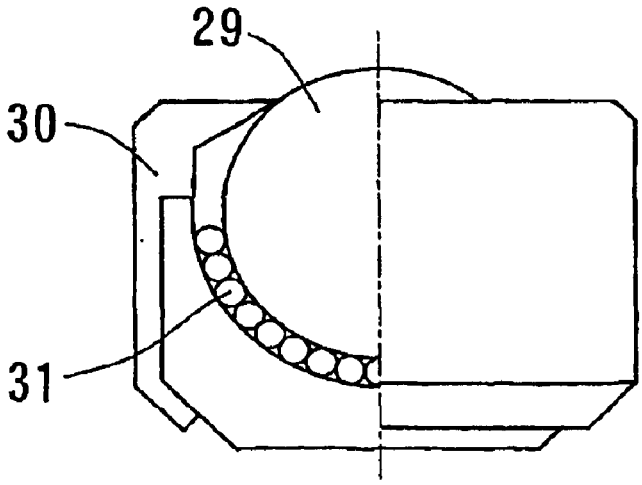
FIG. 6 is a longitudinal sectional view of the case of FIG. 5.

In the embodiment, a plurality of balls 29 are received in a plurality of cases 30 for rotation. The cases 30 are spaced from each other angularly around the shaft 4 at positions between the holders 2. The balls 29 protrude from the outer surface of the cases 30. In the embodiment, each of the cases 30 is stuffed with a number of small spheres 31, the ball 29 being engaged with the small spheres 31 for rotation, as shown in FIG. 5 and FIG. 6. In addition, the cylinder blocks 21 and 22 are interposed between the holders 2, as described above, the cases 30 being spaced from each other at an angle of 45° and embedded in and fixed to the cylinder blocks 21 so that the balls 29 can protrude slightly over the cylinder blocks 21. The cases 30 may be embedded in and fixed to the cylinder blocks 22 so that the balls 29 protrude slightly over the cylinder blocks 22.

In this case, the tips 8 are moved and contracted radially of the shaft 4 to be retracted from the inner surface of the core 1 after winding the web material so that the wound product can be supported on the balls 29. The wound product is then drawn out of the shaft 4 with a resistance reduced by the balls 29 which are rotated in the cases 30 between the holders 2 in accordance with the movement of the wound product. The wound product can therefore drawn without difficulty even if it has a heavy weight.

In the apparatus, the small spheres 31 are rolled and circulated in the cases 30 in accordance with the rotation of the balls 29. The balls 29 can therefore be rotated smoothly even if they subject to large load.

It should also be recognized that the core 1 is rotated by means of the friction generated between the second pistons 15 and the holder 2, so as to wind the web material about the core 1. The core 1 is therefore not rotated integrally with the cylinder blocks 21 and 22. In this connection, the inner surface of the core 1 would not be scrubbed and damaged by the cylinder blocks 21 and 22 but be engaged with and protected by the balls 29 which are rotated by means of the core 1, even if the core 1 is deformed or distorted.

What is claimed is:

1. A winding apparatus for winding a web material such as paper, plastic film about a hollow core including an inner surface, said apparatus comprising:

a ringed holder including an outer surface and an end surface and disposed around and coaxially with a shaft for rotation about said shaft;

a ringed slide including an outer surface and fitted onto the outer surface of said holder for movement axially of said shaft;

a tapered surface formed on the outer surface of said slide;

a plurality of tips spaced from each other angularly around said slide and engaged with said tapered surface for movement radially of said shaft;

first and second pistons disposed on opposite sides of said holder in the axial direction of said shaft and inserted into first and second bores respectively;

a first flow path formed in said shaft, fluid pressure being directed into said first bore through said first flow path so that said slide can be moved axially of said shaft by said first piston, said tips being moved and expanded radially of said shaft by said tapered surface to be pressed against the inner surface of said core so as to hold said core; and a second flow path formed in said shaft independently of said first flow path, fluid pressure being directed into said second bore through said second flow path so that said second piston can be pressed against the end surface of said holder, a torque being transmitted to said holder, said slide, said tips and said core from said shaft by means of a friction generated between said second piston and said holder so that said core can be rotated by said torque.

2. The winding apparatus as set forth in claim 1 wherein a plurality of said holders are combined with a plurality of said slides and spaced axially of said shaft, said tips being spaced from each other angularly around each of said slides, a plurality of cylinder blocks are disposed on said shaft and interposed between said holders, said first and second pistons being inserted into said first and second bores formed in each of said cylinder blocks respectively.

3. The winding apparatus as set forth in claim 2 wherein said cylinder blocks are ringed to be disposed around and coaxially with said shaft, a plurality of said first bores being formed in one of said cylinder blocks to be spaced from each other angularly around said shaft, a plurality of said first pistons being spaced from each other angularly around said shaft and inserted into said first bores, a plurality of second bores being formed in one of said cylinder blocks to be spaced from each other angularly around said shaft, a plurality of said second pistons being spaced from each other angularly around said shaft and inserted into said second bores.

4. The winding apparatus as set forth in claim 2 wherein a ringed coil spring is disposed around said tips and said slide and fitted into circumferential grooves formed in said tips and said slide, said tips being resiliently urged radially of said shaft by said spring to be engaged with said tapered surface.

5. The winding apparatus as set forth in claim 2 wherein a plurality of balls are received in a plurality of cases, said cases being spaced from each other angularly around said shaft at positions between said holders, said balls protruding from the outer surfaces of said cases, said tips being contracted radially of said shaft after winding the web material so that a wound product can be supported on said balls.

* * * * *